United States Patent [19]

Würster et al.

[11] Patent Number: 4,508,991

[45] Date of Patent: Apr. 2, 1985

[54] HALOGEN CYCLE INCANDESCENT LAMP AND METHOD FOR THE PROTECTION OF ITS INNER SURFACE

[75] Inventors: Ewald Würster, Grünwald; Albert Heidemann, Herbrechtingen, both of Fed. Rep. of Germany

[73] Assignee: Patent Treuhand-Gesellschaft für elektrische Glühlampen mbH, Munich, Fed. Rep. of Germany

[21] Appl. No.: 417,866

[22] Filed: Sep. 14, 1982

[30] Foreign Application Priority Data

Oct. 2, 1981 [DE] Fed. Rep. of Germany ..... 3139294

[51] Int. Cl.[3] ..... B05D 5/12; H01K 1/32; H01K 1/50

[52] U.S. Cl. ..... 313/579; 313/635; 427/107; 427/444

[58] Field of Search ..... 427/107, 314, 444; 313/579, 635

[56] References Cited

U.S. PATENT DOCUMENTS 3,418,512 12/1968 Jampens et al. ..... 313/185
4,256,988 3/1981 Coaton et al. ..... 313/221

FOREIGN PATENT DOCUMENTS 2701051 7/1977 Fed. Rep. of Germany .

*Primary Examiner*—Michael R. Lusignan
*Attorney, Agent, or Firm*—Frishauf, Holtz, Goodman & Woodward

[57] ABSTRACT

A halogen cycle incandescent lamp with a bulb of soft glass, the inner surface of the bulb being depleted of alkali ions to avoid a reaction between the halogen constituents of the filling gas and the alkali constituents of the bulb glass. The vacancies thus generated in the glass lattice may be filled by replacement ions such as Li, Mg, Ca and/or the bulb may be coated with a protective layer of a metal and/or semi-metal oxide such as $SiO_2$, $TiO_2$, $B_2O_3$. The sodium ions are removed from the bulb glass by preferably hydrogen chloride or hydrogen bromide gas which acts on the bulb at a temperature between 500° C. and the softening point of the glass. The vacancies are filled by bringing the inner surface of the bulb in contact with molten salts or solutions of salts of Li, Mg or Ca. The protective layer is applied by introducing a metal halide and/or semi-metal halide e.g., $TiCl_4$ or $SiCl_4$ into the bulb which forms metal oxide and/or semi-metal oxide e.g., $TiO_2$ or $SiO_2$ by reaction with hydrogen and oxygen which frees the halide. The protective layer may also be applied by vapor deposition of the respective oxide or by dip process.

23 Claims, No Drawings

HALOGEN CYCLE INCANDESCENT LAMP AND METHOD FOR THE PROTECTION OF ITS INNER SURFACE

BACKGROUND OF THE INVENTION

The invention relates to an improved incandescent lamp comprising a bulb of soft glass having a filling gas containing a halogen constituent, together with the inert gas, in which the halogen constituents of the filling gas do not react with the alkali ions of the glass bulb. The invention also relates to a method for manufacturing such a lamp.

In known halogen cycle incandescent lamps the possibility of a reaction between the halogen constituent of the filling gas and the alkali ions (which are components of many glasses) was avoided because the lamp bulb was manufactured from quartz or hard glass which both contain either no or only minor proportions of alkali ions. Such glasses require high processing temperatures. It was desired to manufacture halogen cycle incandescent lamps having bulbs comprising soft glass.

The hardness of the glass is determined by the linear thermal coefficient of expansion or the socalled transformation temperature, respectively. Glasses containing alkali for instance soda lime glass, have a greater thermal expansion than glasses without alkali content and are called "soft glasses". It is an advantage of these glasses that they may be processed more easily than quartz glasses and hard glasses.

When soft glass bulbs are used for halogen cycle incandescent lamps there arises the difficulty that the halogen of the filling gas reacts with the alkali ions, more particularly with the sodium ions of the bulb glass to yield a thermally stable compound, for instance in accordance with the reaction $Na_2SiO_3+2HBr \rightleftarrows SiO_2+H_2O+2NaBr$. The effective halogen content of the filling gas is reduced. As a result the tungsten halogen cycle process which characterizes the halogen cycle incandescent lamp can no longer be maintained which leads to lamp blackening. In addition, the reaction products of the alkali and halogen cause undesired deposits in the lamp bulb.

To prevent the reaction of the halogen constituents of the filling gas with the alkali constituents of the bulb glass, it has already been proposed in the U.S. Pat. No. 4,256,988 to apply to the inner surface of the bulb and the surfaces of the interior components a coating of a continuous impregnating layer which consists substantially of a metal oxide ($Al_2O_3$). Such halogen cycle incandescent lamps are not manufactured at the present time. Possibly the technique for manufacturing these lamps has not yet matured. Possibly, there is a difficulty in applying a sufficiently dense protective layer so that no alkali ions may diffuse through it without the optical quality of the glass bulb being impaired.

THE INVENTION

The present invention provides a soft glass lamp bulb from which alkali (e.g. sodium) ions have been removed from the inner surface of the bulb. The resulting vacancies in the glass lattice may be filled by other ions and/or the inner surface of the bulb may be coated with an additional layer of a transparent protective metal oxide or semi-metal oxide.

The method of manufacturing the halogen cycle incandescent lamp of the invention corresponds with that of conventional incandescent lamps as described, for example, in U.S. Pat. No. 3,418,512 except for the flushing and filling of the lamp.

In one method of the invention, alkali ions are removed from the inner surface of the lamp bulb with a treating gas which removes alkali ions, for example sodium ions, from the bulb glass. Preferably, a treating gas is used which disassociates to form F, Cl, Br or I, which reacts with the sodium ions of the bulb glass. HCl which reacts to form NaCl in accordance with the following equation is a suitable treating gas.

$$Na_2SiO_3+2HCl \rightleftarrows SiO_2+2NaCl+H_2O$$

The NaCl is readily washed from the lamp bulb with water. When the soft glass permits processing at temperatures above 700° C., this washing is not required as the resulting NaCl is sublimed and flows or may be pumped from the glass bulb with the treating gas.

This flushing treating process to remove alkali ions is intended to prevent the reaction which would take place during operation of the lamp between the halogen constituents of the filling gas and the sodium ions of the bulb glass. However, the process conditions for the process of the present invention must be different than those occuring during operation of the bulb in order to permit this reaction to be carried out in a considerably shorter time.

All references herein to alkali ions refer to the common alkali components of soft glass, i.e., sodium and potassium and do not refer to lithium.

The sodium depletion depth which would be obtained if the halogen cycle incandescent lamp were operated without pretreatment may be calculated with the simplified equation $$x^2=\text{const}\cdot D\cdot t,$$

wherein x=depletion depth const=determined constant

D=diffusion constant for sodium ions t=time (derivation, see "Lehrbucher der Experimentalphysik", e.g. Pohl; "Einfuhrung in die Mechanik, Akustik und Warmelehre") wherein the diffusion constant in turn depends on:

the glass composition and the operating temperature of the lamp bulb.

This sodium depletion depth should be comparable to the depletion depth obtained after the pretreatment of the lamp bulb by the present process so that during the operation of the lamp no deleterious sodium concentration may subsequently diffuse to the inner surface. It is postulated that the reaction speed is determined by the diffusion time required by the sodium ions to travel from the interior of the glass to the surface. Assuming that the diffusion constant of for instance soda lime glass $D=0.005 \exp(-20000/RT)$ (see "Diffusion Studies in Glass" by E. L. Williams from the journal "The Glass Industry", August 1962), the operating temperature is 270° C. (about 540 K.), and the lamp service life is 200 hours, the constant is about 1 and R=2, there results a depletion depth x of $$x \approx \sqrt{D\cdot t} = \sqrt{0.005 \exp\left(\frac{-20000}{2\cdot 540}\right) \frac{\text{cm}^2}{\text{sec}} \cdot 200 \cdot 3600 \text{ sec}}$$

-continued $$x \approx 5.7 \cdot 10^{-3} \text{ cm.}$$

Parameters capable of being influenced are, in accordance with this equation, only the treatment temperature ($T_{Beh.}$) and the treatment duration ($t_{Beh.}$). From this, the following Table may be established:

| $T_{Beh.}$ (°C.) | 500 | 600 | 700 | etc. |
|---|---|---|---|---|
| $t_{Beh.}$ (min) | 47.5 | 10.7 | 3.3 | — |

It is postulated that the diffusion constant between treating temperature and operating temperature changes only because of the temperature, that is, prefactor and activating energy remain unchanged. The processing temperature particularly when using H Halide, e.g. HCl or HBr is preferably between 500° C. and the softening point of the glass. The temperature is higher than the temperature of the glass during service.

The removal of alkali ions from the glass surface may be effected in different stages of the bulb or lamp manufacture. Treatment during the blowing of the bulbs or the drawing of the glass tubes from which the bulbs are made has the advantage that the temperatures required in the present process are also reached in these manufacturing steps so that no additional heating of the glass has to be carried out.

Finished lamp bulbs may be processed to remove alkali from the glass by positioning them in a container through which flows HCl alone or with a carrier gas such as $N_2$, Ar or Kr. The container is heated to a temperature of more than 500° at which the bulbs are treated. In accordance with the above Table, the gas should act at a processing temperature of for instance 700° for at least 3.3 minutes on the inner surface of the lamp bulb in order to ensure that during the lamp operating service life of about 200 hours and a lamp operating temperature of about 270° C. a deleterious amount of sodium will not diffuse to the inner surface.

The processing of the lamp bulbs may be carried out also in a closed container which contains a sufficient quantity of HCl. Because of the alterations of the glass surfaces caused by the extraction of sodium, such as generation of strains, raising of the softening temperature, it is advantageous, to treat only those bulb portions which do not lie in the region of the press portion or seal of the finished incandescent lamp. For this purpose, the treatment gas may be blown into the simultaneously heated bulb.

The process may also be carried out with a finished lamp still carrying the exhaust tube, for instance during the exhausting and flushing operation prior to the filling of the lamp. Alkali depletion at this stage of the lamp manufacture has the additional advantage that in the subsequent manufacturing steps no temperatures will occur which may lead to a subsequent diffusion of sodium ions from the interior of the glass to portions of the glass adjacent the inner surface of the bulb as is the case for instance when the lamp bulb is sealed to the stem. The reaction products are pumped or flushed from the lamp through the exhaust tube after the treatment.

In all the afore-described process embodiments, more particularly in the treatments carried out prior to the pressing or sealing of the lamp, it is advantageous to subject the treated bulbs to a tempering step in order to avoid the hazard of glass cracks. After the alkali depletion in the region of the inner surface of the lamp bulb has been completed, the lamp may be filled with its final filling gas.

It is also possible to fill the vacancies in the glass lattice generated by the removal of alkali ions, by adding other ions. This prevents a too fast subsequent diffusion to the surface of the sodium ions lying in the deeper regions. Ions of magnesium, calcium or lithium are particularly suited for filling these lattice vacancies as their diameters are about equally large as the diameters of the sodium ions. The glass lattice is hardly changed by the incorporation of these ions, and strains in the bulb glass do not occur. Two $Na^+$ ions are replaced by one $Mg^{2+}$ or $Ca^{2+}$ ion. Owing to the double interlinking in the glass lattice resulting therefrom, magnesium and/or calcium ions are markedly more inert so far as diffusion and reaction is concerned than sodium ions and therefore do not form a compound with the halogen constituents of the filling gas of the lamp. When lithium ions are used as replacement ions, the alkaline earth type characteristic of the lithium ions is utilized.

The replacement ions are incorporated into the vacancies by bringing molten salts or solutions of salts of these ions into contact with the sodium depleted glass surface. The dissociated ions diffuse into the glass surface where they saturate the free bonds generated by the sodium extraction. It is also possible after this processing step to fill the lamp with its final filling gas and to finish it in the same manner as conventional incandescent lamps.

Both after the alkali depletion and/or after the filling of the vacancies in the glass lattice with the replacement ions, the inner surface of the lamp bulb may be provided with an additional protective barrier layer which offers added security that sodium ions will not contaminate the filling gas of the halogen cycle incandescent lamp. The barrier layer is applied to the inner surface of the bulb in the form of a metal- and/or semi-metal halogen compound, for example $TiCl_4$, $SiCl_4$ and forms the corresponding metal oxide and/or semi-metal oxide by a reaction with hydrogen and oxygen which sets free the halogen either on the said inner surface of the bulb or in close proximity thereto in accordance with the equation:

$$TiCl_4 + 2H_2O_2 \rightarrow TiO_2 + 4HCl \uparrow .$$

The transparent semi-metal oxides may also be used, e.g. $B_2O_3$.

When this protective coating is applied to the inner surface of the treated soft glass bulb it is advantageous, that the halogen constituents of the metal- and/or semi-metal halogen compound correspond to those of the filling gas and remain in the lamp as a halogen additive after the reaction has been terminated. This reaction may also be carried out in the finished lamp.

The barrier layer which is preferably resistant to the halogen and also to diffusion of alkali ions from the glass may also be applied by a dip process, e.g. by contacting the inner surface of bulb with a $SiO_2$-containing dispersion or solution or sol.

The lamp bulbs of the present invention can be used in all conventional lamps which did not contain halides. It is now possible to add halogen to such lamps if the operating temperature of the bulb is above 200° C. so that the tungsten halogen cycle process may be used. The halogen prevents premature blackening. The lamps in accordance with the present invention may in addition be manufactured at lower cost due to the lower processing temperatures than when using quartz or hard glass.

EXAMPLE

For the halogen cycle incandescent lamp of the invention there is used a soda lime silicate having a composition of about 72.3% $SiO_2$
1.3% $Al_2O_3$
5.3% CaO
3.0% MgO
17.1% $Na_2O$
0.5% $K_2O$ and
0.5% other materials.

This bulb is flushed with hydrochloric acid—5 to 10% in argon as a carrier gas—at a temperature of 650° C. for about 15 minutes, whereby the sodium ions are removed from the bulb glass and combine with the chlorine ions of the hydrochloric acid. The common salt formed by this reaction is then washed from the lamp bulb with water.

In order to fill the vacancies in the glass lattice, a heated aqueous solution of lithium chloride is introduced into the bulb. The dissociated lithium ions enter into the glass surface and saturate the free bonds resulting from the sodium extraction. The lamp bulb is then filled with an inert filling gas which comprises a halogen additive ($CH_2Br_2$), and is subsequently closed and based. A lamp of this type may be used, for instance, as a stop light in automotive vehicles.

We claim:

1. A halogen cycle incandescent lamp having a bulb comprising a potassium or sodium containing soft glass and an inert fill containing a halogen additive, the inner surface of said soft glass having been treated to remove the potassium or sodium ions therefrom so that during operation of the lamp, the sodium or potassium component of the soft glass will not be available to react with the halogen additive component of the fill gas.

2. The lamp of claim 1 wherein the potassium or sodium which has been removed from the inner surface of the soft glass has been replaced by replacement ions.

3. The lamp of claim 2 wherein the replacement ions are selected from the group consisting of alkaline earth metals and lithium.

4. The lamp of claim 3 wherein said replacement ions have substantially the same diameter as the potassium or sodium which was replaced.

5. The lamp of claim 1 wherein said soft glass contains sodium ions which have been removed from the inner surface thereof and replaced by ions selected from the group consisting of lithium, magnesium and calcium.

6. The lamp of claim 1 or 3 or 5 wherein the inner surface of the soft glass bulb is coated with a halogen-resistant barrier layer.

7. The lamp of claim 6 wherein said barrier layer consists of coating of at least one transparent oxide selected from the group consisting of metal oxide and semi-metal oxide.

8. The lamp of claim 7 wherein said barrier layer consists of a coating of at least one oxide selected from the group consisting of $SiO_2$, $TiO_2$ and $B_2O_3$.

9. A method for manufacturing a halogen cycle incandescent lamp having a bulb comprising a potassium or sodium containing soft glass and an inert fill containing a halogen additive, the inner surface of said soft glass having been treated to remove the potassium or sodium ions therefrom so that during operation of the lamp the sodium or potassium component of the soft glass will not be available to react with the halogen additive component of the fill gas;

comprising passing a gas through the interior of the lamp bulb and reacting said gas with the sodium or potassium content of the soft glass to form sodium or potassium compounds and removing said compounds from the lamp bulb.

10. The method of claim 9 wherein said gas contains halides which react with said potassium or sodium to form the corresponding potassium or sodium halide which is then removed from the lamp bulb.

11. The method of claim 9 wherein said gas is a hydrogen halide selected from the group consisting of hydrogen chloride and hydrogen bromide, or said hydrogen halide together with a carrier gas selected from the group consisting of $N_2$, Ar and Kr.

12. The method of claim 9 wherein said gas is contacted with the inner surface of said soft glass bulb at a temperature which is higher than the surface temperature of the bulb during operation of the lamp.

13. The method of claim 11 wherein said hydrogen halide is contacted with the inner surface of said soft glass bulb at a temperature between 500° C. and the softening point of said soft glass.

14. The process of claim 13 wherein said hydrogen halide contains the same halide as the halogen component of the lamp fill.

15. The method of claim 9 or 14 wherein said soft glass is a sodium-containing soft glass and wherein a compound selected from the group consisting of lithium salts, magnesium salts and calcium salts is contacted with the inner surface of the lamp bulb after sodium has been removed therefrom whereby said lithium, magnesium or calcium ions can diffuse into the soft glass and replace the sodium ions which had been removed therefrom.

16. The method of claim 15 wherein the inner surface of the soft glass of the lamp bulb containing lithium, magnesium or calcium ions is coated with a halogen resistant barrier layer, said layer being a transparent metal oxide or transparent semi-oxide produced by reacting the corresponding metal halide or semi-metal halide with hydrogen and oxygen to form the free halide in the bulb.

17. The method of claim 9 or 13 wherein the inner surface of said glass bulb from which potassium or sodium has been removed is coated with a halogen resistant barrier layer, said layer being a transparent metal oxide or transparent semi-oxide produced by reacting the corresponding metal halide or semi-metal halide with hydrogen and oxygen to form the free halide in the bulb.

18. The method of claim 16 wherein said barrier layer is formed by reacting a metal chloride with hydrogen and oxygen to form a transparent metal oxide and free chlorine.

19. The method of claim 16 wherein the metal halide or semi-metal halide contains the same halide as in the halogen constituent of the fill gas and remains in the lamp as a halogen additive.

20. The method of claim 19 wherein said reaction of the metal halide or semi-metal halide with hydrogen and oxygen is carried out in the finished lamp.

21. The method of claim 15 wherein a halogen resistant barrier layer is applied over the inner surface of said soft glass containing said lithium, magnesium or calcium ions by vapor depositing a transparent metal oxide or a transparent semi-metal oxide thereon.

22. The method of claim 15 wherein a halogen resistant barrier layer is coated on the inner surface of said soft glass bulb containing said lithium, magnesium or calcium ions by dipping said glass bulbs into a melt or solution from which barrier layer is deposited on the inner surface of said glass bulb.

23. The method of claim 13 wherein said soft glass prior to treatment contains a large amount of $Na_2O$ in the surface portions thereof, and wherein said bulb containing said sodium containing soft glass is flushed with hydrochloric acid to form sodium chloride; washing said sodium chloride from the lamp with water; introducing into said lamp a heated aqueous solution of lithium chloride which results in lithium ions entering the glass surface and filling vacancies resulting from the sodium extraction; and then filling the lamp bulb with an inert fill gas which contains a bromine additive.

* * * * *